United States Patent [19]

Tsuda et al.

[11] Patent Number: 4,587,207

[45] Date of Patent: May 6, 1986

[54] COLOR IMAGE-FORMING PROCESS

[75] Inventors: Momotoshi Tsuda; Jun Arakawa, both of Kanagawa, Japan

[73] Assignee: Fuji Photo Film Co., Ltd., Kanagawa, Japan

[21] Appl. No.: 654,446

[22] Filed: Sep. 26, 1984

[30] Foreign Application Priority Data

Sep. 27, 1983 [JP] Japan ..... 58-178755

[51] Int. Cl.[4] ..... G03C 7/16

[52] U.S. Cl. ..... 430/389; 430/557; 430/558

[58] Field of Search ..... 430/389, 557, 558

[56] References Cited

U.S. PATENT DOCUMENTS

| | | | |
|---|---|---|---|
| 3,849,140 | 11/1974 | Kuffner et al. | 430/557 |
| 3,998,641 | 12/1976 | Schranz et al. | 430/557 |
| 4,186,019 | 1/1980 | Kunitz et al. | 430/389 |
| 4,336,327 | 6/1982 | Tanaka et al. | 430/557 |
| 4,401,752 | 8/1983 | Lau | 430/389 |

*Primary Examiner*—J. Travis Brown

*Attorney, Agent, or Firm*—Sughrue, Mion, Zinn, Macpeak & Seas

[57] ABSTRACT

A color image-forming process is described, comprising developing an exposed silver halide light-sensitive material with an aromatic primary amine color developing agent in the presence of an $\alpha$-acyl-$\alpha$-unsubstituted or substituted phenoxyacetanilide type yellow coupler having a sulfamoyl group in an m-position of the acetanilido group with respect to the amino group.

7 Claims, No Drawings

COLOR IMAGE-FORMING PROCESS

FIELD OF THE INVENTION

This invention relates to a color photographic image-forming process, and, more particularly, to a color photographic image-forming process using a novel yellow dye-forming coupler. That is, it relates to a process for forming a yellow dye image in the presence of a novel yellow coupler which shows excellent solubility, dispersion stability, and spectral absorption characteristics, which forms a dye with high coloration density and excellent stability at a high rate in, particularly, a benzyl alcohol-free color development processing solution, and which does not undergo serious change in coupling reactivity even when the pH of the color developer is changed.

BACKGROUND OF THE INVENTION

As is well known, in subtractive color photographic processes, an oxidation product of an aromatic primary amine type color developing agent, produced by reduction of exposed silver halide grains with the color developing agent, is oxidatively coupled with yellow, cyan, and magenta dye-forming couplers in silver halide emulsions to form color images.

In this process, active methylene group-containing compounds are generally used as yellow couplers for forming yellow dye (i.e., "yellow couplers", etc., as used herein refers to yellow-dye-forming couplers, etc.); pyrazolone type, pyrazolobenzimidazole type, or indazolone type compounds are used as magenta couplers for forming magenta dyes; and phenolic or naphtholic type compounds are used as cyan couplers for forming cyan dyes.

Typically, each coupler is added to a silver halide emulsion as a solution thereof dissolved in a high-boiling organic solvent which is substantially insoluble in water together, if necessary, with an auxiliary solvent, or as an alkaline aqueous solution thereof. In general, the former method provides better light fastness, humidity resistance, heat resistance, graininess, and color sharpness than the latter.

Each coupler should not only merely form a dye, but should also have a large solubility in a high-boiling organic solvent or an alkali and a good dispersibility and stability in a silver halide photographic emulsion, to form a dye with good fastness to light, heat, and humidity, to possess excellent spectral absorption characteristics and good transparency, and to form a distinct image with, as is more important, high color density and large dye-forming rate.

Furthermore, it has become economically necessary to avoid use of benzyl alcohol, conventionally added upon color development processing, for the purpose of reducing the cost for processing waste liquor. However, under the present techniques, in general, the use of a benzyl alcohol-free color developing solution deteriorates coloration properties of couplers added to silver halide photographic emulsions, that is, it decelerates the dye-forming rate and reduces maximum color density. Therefore, it has been desired to develop yellow couplers whose coloration properties do not depend upon benzyl alcohol and which form images with improved preservability. Conventionally known yellow couplers are generally so dependent upon pH as to coloration properties that extremely strict and careful control of pH has been required during color development processing. However, optimal pH of color development usually varies somewhat depending upon individual color developing agents, couplers, or the combination of couplers. Thus, yellow couplers whose coloration properties are less pH-dependent are required. Yellow couplers fully satisfying the above-described requirements have not yet been found, however.

Conventionally known yellow couplers are as follows. For example, U.S. Pat. No. 3,408,194 describes yellow couplers which have a sulfamoyl group in the 4-position of α-pivaloylacetanilide and in which one hydrogen atom in the active site is substituted by an aryloxy group. These couplers form dyes with poor preservability and imperfect spectral absorption characteristics, and thus are not satisfactory.

Japanese Patent Application (OPI) No. 87650/75 describes yellow couplers which possess an alkylsulfonamido bond, an aralkylsulfonamido bond, a benzenesulfonamido bond, an alkoxybenzenesulfonamido bond or an arylsulfonamido bond in the 5-position of α-pivaloylacetanilide, and in which one hydrogen atom in the active site is substituted by an aryloxy group (the term "OPI" as used herein refers to a "published unexamined Japanese patent application"). Some of these couplers are not substantially responsive to pH-change of developer as to coupling reactivity, but they form dyes with poor preservability and generally show unsatisfactory coupling reactivity in a benzyl alcohol-free color development processing solution.

Japanese Patent Application (OPI) Nos. 115219/77 and 48541/79 describe yellow couplers which have an alkylsulfonamido bond or a phenoxyalkylsulfonamido bond in the 5-position of α-acylacetanilide and in which a heterocyclic ring is bound to the active site via the nitrogen atom of the heterocyclic ring. These couplers do not show sufficient coloration properties in color development processing not using benzyl alcohol.

Japanese Patent Application (OPI) No. 142340/80 describes couplers which have an alkoxyalkylsulfonamido group in the 3-position of α-acylacetanilide. These couplers have an ether bond in the hydrophobic alkyl moiety of the alkylsulfonamido group to increase hydrophilicity, and, as a result, increase coupling activity of the couplers. However, they still do not completely satisfy the requirements described hereinbefore.

SUMMARY OF THE INVENTION

It is, therefore, an object of the present invention to provide novel yellow couplers showing sufficient coupling activity in a development processing system using a benzyl alcohol-free color developer, and a yellow dye image-forming process utilizing such couplers.

Another object of the present invention is to provide novel yellow couplers which are not responsive to a change in the pH of a color developer, which can thereby depress fluctuation in the dye image, and a process for forming the dye image.

A further object of the present invention is to provide novel yellow couplers which form dye images with excellent preservability, i.e., excellent light fastness, heat resistance, and humidity resistance.

Still a further object of the present invention is to provide novel yellow couplers which have excellent solubility in alkalis or high-boiling organic solvents, and excellent dispersibility and stability in silver halide color photographic emulsions.

Also still a further object of the present invention is to provide a photographic light-sensitive material suited for high temperature rapid processing using novel yellow couplers.

Yet another further object of the present invention is to provide novel yellow couplers which have a sulfamoyl group and which can be synthesized with economical advantage from easily available starting materials.

These objects of the present invention have successfully been attained by a color image-forming process which comprises developing an exposed silver halide light-sensitive material with an aromatic primary amine color developing agent in the presence of an α-acyl-α-unsubstituted or substituted phenoxyacetanilide type yellow coupler having a sulfamoyl group in a m-position of acetanilido group with respect to the amino group.

DETAILED DESCRIPTION OF THE INVENTION

In a preferable embodiment of the color image-forming process of the present invention, the above-described yellow coupler is incorporated in a silver halide light-sensitive material.

As will become apparent from the Examples and other descriptions of the present specification, the couplers of the present invention show particularly excellent coloration properties, whose effect is particularly remarkable in a benzyl alcohol-free system.

It has also been confirmed that the couplers are stable and scarcely undergo change in coloration properties even when the pH of color developer is changed (for example, from 10.0 to 11.5).

The effects of the present invention can be achieved within the pH range of the color developer of from 8.5 to 13.

Of the yellow couplers of the present invention, particularly preferable couplers are those represented by formula (I):

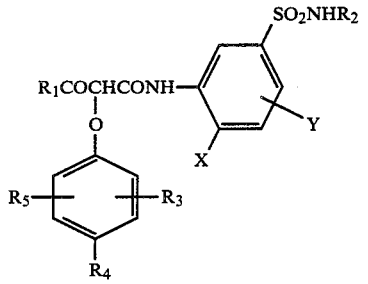

(I)

In above formula (I), $R_1$ represents an alkyl group (preferably a branched alkyl group containing from 3 to 8 carbon atoms, e.g., an isopropyl group, a tert-butyl group, a tert-amyl group, etc.) or an unsubstituted or substituted aryl group. Examples of the substituent include a lower alkyl group containing from 1 to 5 carbon atoms (e.g., a methyl group, an ethyl group, an isopropyl group, a tert-butyl group, a tert-amyl group, etc.), a straight or branched alkoxy group containing from 1 to 30 carbon atoms (e.g., a methoxy group, an ethoxy group, a butoxy group, a methoxyethoxy group, a dodecyloxy group, a hexadecyloxy group, an octadecyloxy group, etc.), a halogen atom (e.g., a fluorine atom, a chlorine atom, a bromine atom, an iodine atom, etc.), or an acylamino group (e.g., an α-(2,4-di-t-amylphenoxy)acetamido group, an α-(2,4-di-t-amylphenoxy)butyramido group, a γ-(3-pentadecylphenoxy)-butyramido group, etc.). The aryl group may have one or more of these substituents.

$R_2$ represents a straight or branched alkyl group containing from 1 to 32 carbon atoms (e.g., a methyl group, an ethyl group, a propyl group, a butyl group, a dodecyl group, a tetradecyl group, a pentadecyl group, an octadecyl group, etc.) or an aryl group containing from 6 to 32 carbon atoms (e.g., a phenyl group), which may optionally be substituted by, for example, an aryloxy group (preferably a 2,4-di-t-amylphenoxy group), an aryl group (preferably a phenyl group), an alkoxycarbonyl group (preferably a dodecyloxycarbonyl group, a 3,5-dioctyloxycarbonyl group, etc,), an alkoxy group (preferably a methoxy group, a dodecyloxy group, an octadecyloxy group, etc.), etc.

X represents a halogen atom (e.g., a fluorine atom, a chlorine atom, a bromine atom, or an iodine atom), an alkoxy group containing from 1 to 30 carbon atoms (e.g., a methoxy group, an ethoxy group, an methoxyethoxy group, a dodecyloxy group, an octadecyloxy group, etc.) or a dialkylamino group (e.g., a dimethylamino group, a diethylamino group, etc.).

Y represents a hydrogen atom or a group capable of being bound to a benzene ring, preferably a halogen atom, a halogen-substituted alkyl group, a cyano group, or an acyl group. Preferable examples of the group include a chlorine atom, a fluorine atom, a trifluoromethyl group, etc.

$R_3$ and $R_5$ each represents a hydrogen atom or a group capable of being bound to a benzene ring, for example, one of those described with respect to $R_4$. Preferable examples thereof include:

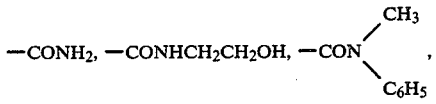

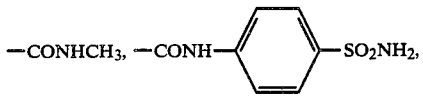

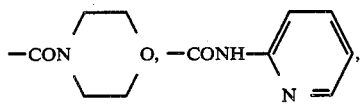

—CONHNHCONH$_2$, —NHCOCH$_3$, —NCOCH$_3$, (CH$_3$)

—NHSO$_2$CH$_3$, —NHCOCF$_3$, —SO$_2$CH$_3$, —CH$_2$NHCOCH$_3$, etc.

$R_4$ represents a hydrogen atom, a halogen atom, a carboxyl group, an alkyloxycarbonyl group (preferably a methoxycarbonyl group, an ethoxycarbonyl group, a butoxycarbonyl group, etc.), an aryloxycarbonyl group (preferably a phenoxycarbonyl group), an arylsulfonyl group (preferably

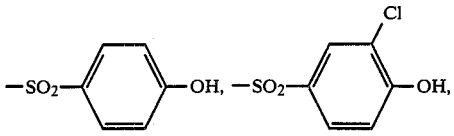

-continued

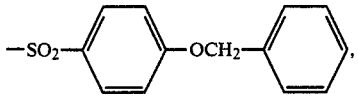

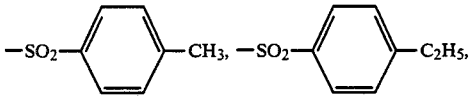

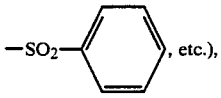

an alkylsulfonyl group (preferably $-SO_2CH_3$, $-SO_2C_2H_5$, $-SO_2NHCH_2CH_2OH$, etc.), an arylsulfamoyl group (preferably

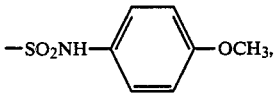

-continued

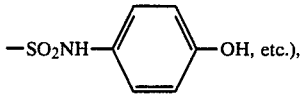

an arylsulfonamido group (preferably

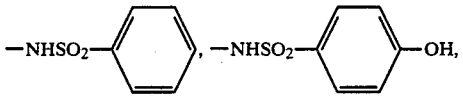

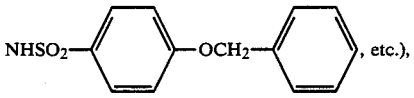

an alkyl group, an alkoxy group, a nitro group, a cyano group, or a carbamoyl group.

Typical specific examples of the couplers of the present invention are illustrated below which, however, do not limit the couplers of the present invention in any way.

Couplers:

1.

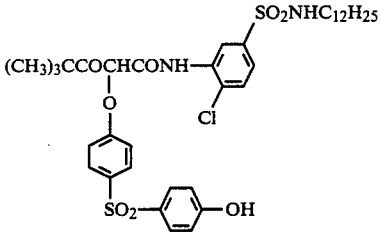

2.

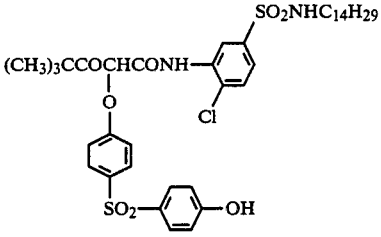

3.

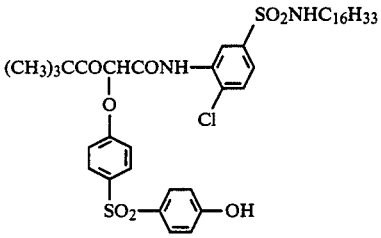

4.

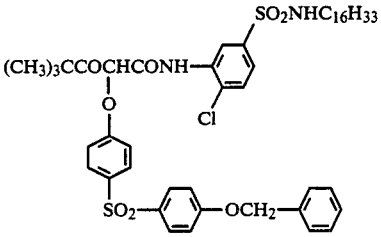

5.

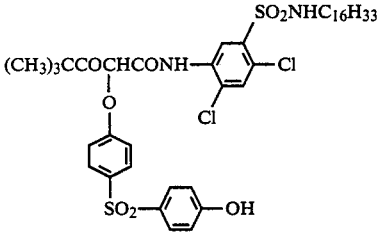

6.

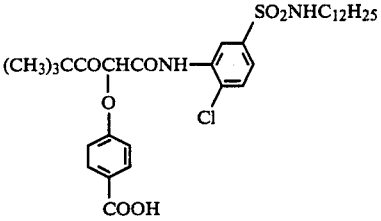

7.

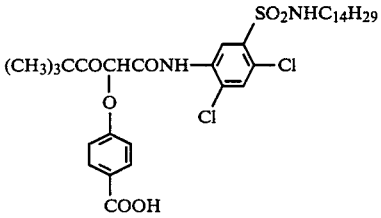

8.

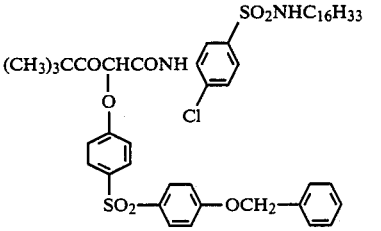

-continued
Couplers:
9.
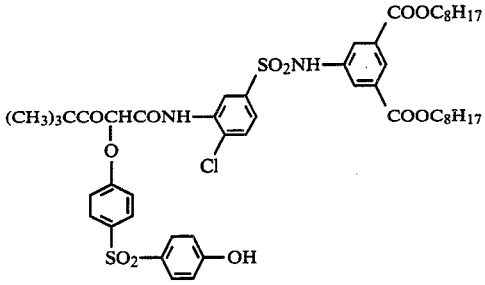
10.
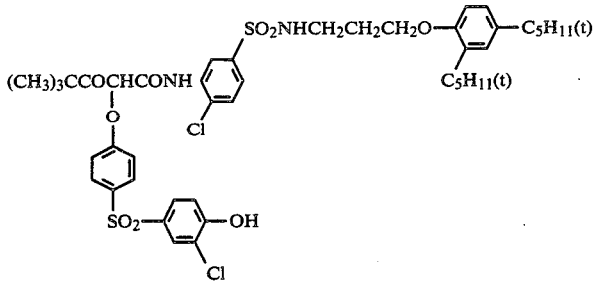
11.
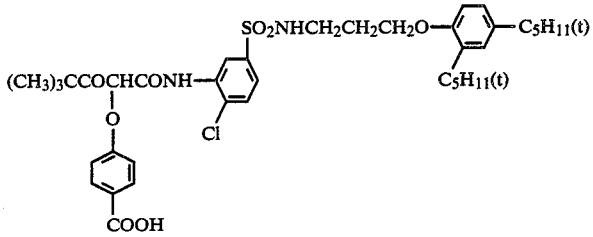
12.
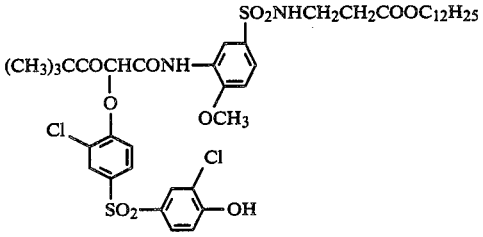
13.
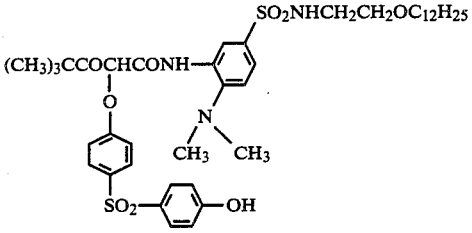
14.
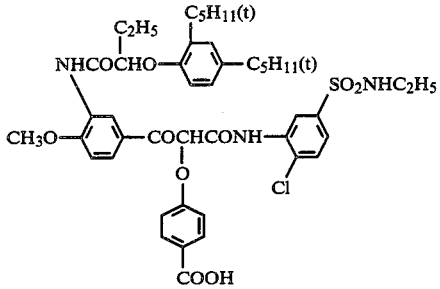
15.
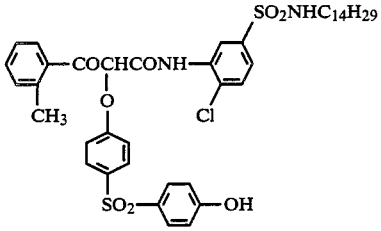
16.
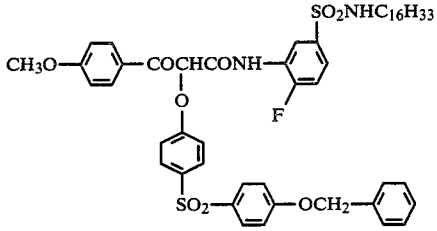
17.
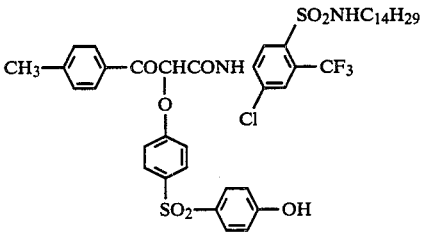
18.
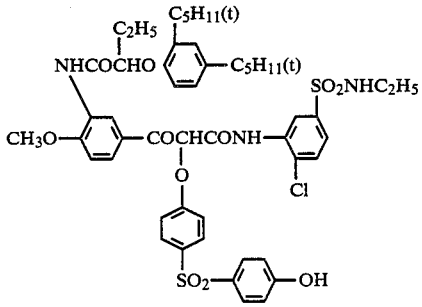

-continued

Couplers:

19.

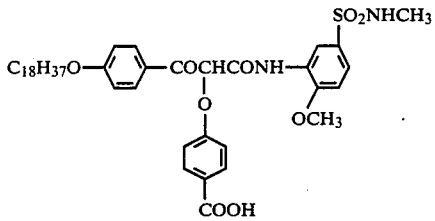

20.

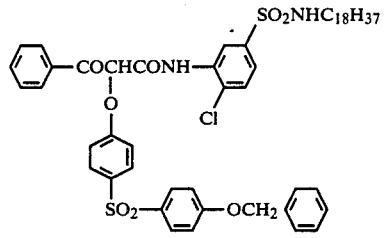

21.

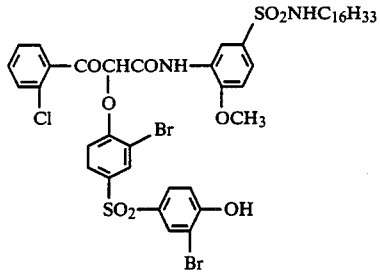

22.

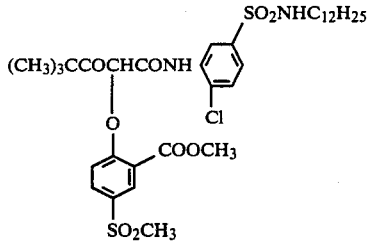

23.

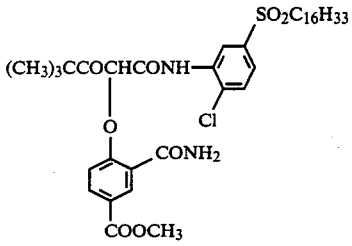

24.

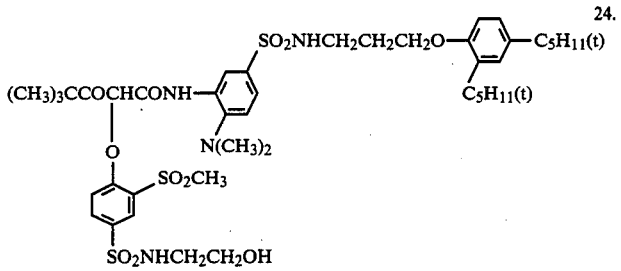

25.

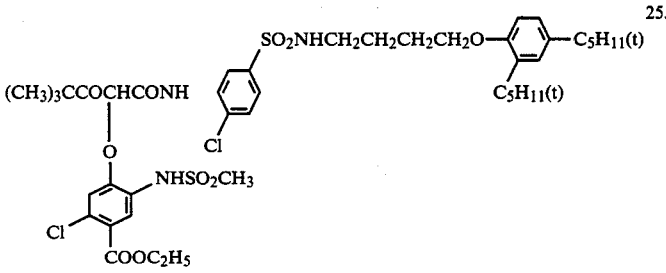

26.

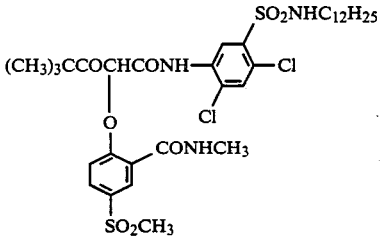

27.

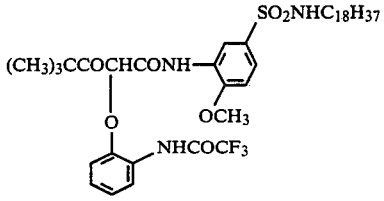

Typical examples of synthesizing couplers in accordance with the present invention are specifically described below.

SYNTHESIS EXAMPLE 1

Synthesis of α-pivaloyl-α-[4-(4-hydroxybenzenesulfonyl)phenoxy]-2-chloro-5-N-dodecanesulfamoylacetanilide (Coupler 1)

10 g of 60-pivaloyl-2-chloro-5-dodecanesulfamoylacetanilide was dissolved in 100 ml of methylene chloride, and 2.7 g of sulfurly chloride was added dropwise thereto while cooling to react. The reaction solution was then washed with water to obtain a solution of α-pivaloyl-α-chloro-2-chloro-5-N-dodecanesulfamoylacetanilide in methylene chloride. This solution was added dropwise to a solution of 35 g of 4,4'-dihydroxydiphenylsulfone, 100 ml of dimethylformamide and 5 ml of triethylamine at 50° to 60° C. to react. After completion of the reaction, the reaction, solution was treated with a 10% sodium hydroxide aqueous solution to remove excess 4,4'-dihydroxydiphenylsulfone. The methylene chloride solution was acidified with hydrochloric acid, washed with water, dried, and concentrated to obtain an oil. Methanol was added to this oil to crystallize. Thus, there were obtained 12 g (80%) of white crystals (Coupler 1). The crystals were identified through NMR and mass spectrum.

Elemental analysis:

| | C (%) | H (%) | N (%) |
|---|---|---|---|
| Calculated: | 59.31 | 6.54 | 3.71 |
| Found: | 59.05 | 6.42 | 3.68 |

SYNTHESIS EXAMPLE 2

Synthesis of α-pivaloyl-α-(4-carboxyphenoxy)-2-chloro-5-N-dodecanesulfamoylacetanilide (Coupler 6)

12 g of α-pivaloyl-2-chloro-5-(dodecanesulfamoyl-)acetanilide was dissolved in 40 ml of methylene chloride, and 4 g of bromine was added dropwise thereto under cooling to react. The reaction solution was washed with water, and the methylene chloride was concentrated to obtain an oil. This oil was dissolved in 40 ml of acetonitrile, and the resulting solution was added to a solution of 6.4 g of benzyl p-hydroxybenzoate in 40 ml of dimethylformamide. Then, 6 g of triethylamine was added dropwise thereto, and reaction was conducted at room temperature for 4 hours. The reaction solution was poured into ethyl acetate, and the resulting solution was acidified with hydrochloric acid, washed with water, dried, and concentrated to obtain 16 g of an oil.

This oil was again dissolved in 100 ml of ethyl acetate, 0.5 g of palladium-on-carbon was added thereto, and reaction was conducted in a 200 ml autoclave under a hydrogen pressure of 50 kg/cm$^2$ at 65° to 70° C. for 3 hours. After filtering off the catalyst, the reaction solution was concentrated to obtain an oil. This oil was dissolved in acetonitrile under heating, then cooled to obtain 10 g of white crystals having a melting point of 116° to 117° C. The crystals were identified through NMR and mass spectrum.

Elemental analysis:

| | C (%) | H (%) | N (%) |
|---|---|---|---|
| Calculated: | 60.32 | 7.06 | 4.39 |
| Found: | 60.28 | 7.11 | 4.37 |

The couplers of the present invention may be used in combination with other color image-forming couplers outside the scope of the present invention. As such couplers, non-diffusible couplers having a hydrophobic group, called a ballast group, in the molecule are desirable. The couplers may be of either the 4-equivalent type or 2-equivalent type (based on the silver ion). Colored couplers having color correcting effect or couplers capable of releasing a development inhibitor as development proceeds (called DIR couplers) may also be incorporated. The couplers may also be those which form a colorless coupling reaction product.

As yellow color-forming couplers, known open-chain ketomethylene couplers may be used. Of these, benzoylacetanilide type and pivaloylacetanilide type compounds are advantageous.

As magenta color-forming couplers, pyrazolone type compounds, indazolone type compounds, cyanoacetyl compounds, etc., may be used, with pyrazolone type compounds being particularly advantageous. Also, pyrazolotriazole type compounds, pyrazoloimidazole type compounds, and pyrazolopyrazole type compounds may be advantageously used.

As cyan color-forming couplers, phenolic compounds and naphtholic compounds may be used.

In addition, colored couplers and DIR couplers (particularly, DIR couplers releasing a development inhibitor with high diffusibility) may also be used in combination.

In addition to the DIR couplers, compounds capable of releasing a development inhibitor as development proceeds may be incorporated in the light-sensitive material. For example, those described in U.S. Pat. Nos. 3,297,445 and 3,379,529, West German Patent Application (OLS) No. 2,417,914, and Japanese Patent Application (OPI) Nos. 15271/77 and 9116/78 may be used.

The couplers of the present invention may be incorporated in combination of two or more in the same single layer, or the same compound may be incorporated in two or more different layers.

The coupler of the present invention is added to an emulsion layer generally in an amount of from $2\times10^{-3}$ mol to $5\times10^{-1}$ mol, preferably from $1\times10^{-2}$ mol to $5\times10^{-1}$ mol, per mol of silver in the emulsion layer. In the case of using the coupler of the present invention together with other couplers described above, the total amount of the couplers forming the same color desirably falls within the above-described range.

In introducing these couplers into the silver halide emulsion layer or layers, known methods such as that described in U.S. Pat. No. 2,322,027 are employed. For example, the couplers are dissolved in an alkyl phthalate (e.g., dibutyl phthalate, dioctyl phthalate, etc.), a phosphoric acid ester (e.g., diphenyl phosphate, triphenyl phosphate, tricresyl phosphate, dioctybutyl phosphate, etc.), a citric acid ester (e.g., tributyl acetylcitrate), a benzoic acid ester (e.g., octyl benzoate), an alkylamide (e.g., diethyllaurylamide), a fatty acid ester (e.g., dibutoxyethyl succinate, dioctyl azelate, etc.), or an organic solvent having a boiling point of about 30+ C. to 150° C., such as a lower alkyl acetate (e.g., ethyl acetate, butyl acetate, etc.), ethyl propionate, sec-butyl alcohol, methyl isobutyl ketone, β-ethoxyethyl acetate, methyl cellosolve acetate, etc., then dispersed in a hydrophilic colloid. The above-described high-boiling organic solvents and the low-boiling organic solvents may be mixed to use.

In addition, a dispersing method using a polymer as described in Japanese Patent Publication No. 39853/76 and Japanese Patent Application (OPI) No. 59943/76 may also be used.

In the case that the coupler has an acid group such as a carboxylic acid group or a sulfonic acid group, they are introduced into a hydrophilic colloid as an alkaline aqueous solution.

The light-sensitive material to be prepared by applying the present invention may contain an ultraviolet ray absorbent in its hydrophilic layer. For example, aryl group-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic acid ester compounds (e.g., those described in U.S. Pat. Nos. 3,705,805 and 3,707,375), butadiene compounds (e.g., those described in U.S. Pat. No. 4,045,229), or benzoxazole compounds (e.g., those described in U.S. Pat. No. 3,700,455) may be used. Further, those described in U.S. Pat. No. 3,499,762 and Japanese Patent Application (OPI) No. 48535/79 may be used. UV ray-absorbing couplers (for example, α-naphtholic type cyan dye-forming couplers) or UV ray-absorbing polymers may also be used. These UV ray absorbents may be mordanted to a specific layer.

Photographic emulsions to be used in the present invention may be prepared according to the processes described, for example, in P. Glafkides, *Chimie et Physique Photographique,* (Paul Montel, 1967); G. G. Duffin, *Photographic Emulsion Chemistry,* (The Focal Press, 1966); V. L. Zelikman et al, *Making and Coating Photographic Emulsion,* (The Focal Press, 1964), and the like.

In the present invention, silver halide emulsions containing grains of regular crystal form having a substantially uniform grain size may also be used.

Two or more separately prepared silver halide emulsions may be mixed for use.

The coupler of the present invention may be used in combination with an emulsion in which tubular grains, preferably having a grain diameter-to-thickness ratio of 5/1 or more, and more preferably of 8/1 or more, account for 50% or more of the total projected area.

In the course of formation or physical ripening of silver halide grains, cadmium salts, zinc salts, lead salts, thallium salts, iridium salts or complex salts thereof, rhodium salts or complex salts thereof, or iron salts or complex salts thereof may be allowed to coexist in the system.

As a binder or protective colloid in the photographic emulsion, gelatin is advantageously used, but other hydrophilic colloids are usable as well.

Various compounds may be added to the photographic emulsion to be used in the present invention for the purpose of preventing fog or stabilizing photographic properties in the steps of producing, or during storage or photographic processing of, light-sensitive materials. That is, many compounds known as antifoggants or stabilizers, such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.; mercaptopyrimidines; mercaptotriazines; thioketo compounds (e.g., oxazolinethiones); azaindenes (e.g., triazaindenes, tetraazaindenes (particularly, 4-hydroxy-substituted (1,3,3a,7)tetraazaindenes), pentaazaindenes, etc.); benzenethiosulfonic acid; benzenesulfinic acid; benzenesulfonamides; etc.; can be added.

The photographic emulsion layer of the photographic light-sensitive material of the present invention may contain, for example, a polyalkylene oxide or its ether, ester, or amine derivative, a thioether compound, a thiomorpholine, a quaternary ammonium salt compound, a urethane derivative, a urea derivative, an imidazole derivative, a 3-pyrazolidone, etc., for the purpose of enhancing sensitivity or contrast or for accelerating development.

The photographic emulsion to be used in the present invention may be spectrally sensitized with methine dyes or the like. Usable dyes include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those which belong to cyanine dyes, merocyanine dyes, and complex merocyanine dyes. In these dyes, any of nuclei ordinarily used as basic heterocyclic nuclei in cyanine dyes can be used. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring and those in which these nuclei are fused with an aromatic ring; i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. can be used. These nuclei may be substituted in the nuclei carbon atoms.

In the merocyanine dyes or complex merocyanine dyes, 5- or 6-membered heterocyclic nuclei such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc., may be used as a ketomethylene structure-containing nuclei.

These sensitizing dyes may be used alone or in combination. Combination of sensitizing dyes is often desirably employed, particularly for the purpose of super-sensitization.

A dye which itself does not have a spectral sensitizing effect or a substance which does not substantially absorb visible light and which shows a super-sensitizing effect may be incorporated in the emulsion together with the sensitizing dye.

The light-sensitive material prepared by the present invention may contain in its hydrophilic colloid layer a water-soluble dye as a filter dye or for various purposes such as prevention of irradiation. Such a dye includes oxonol dyes, hemioxonol dyes, styryl dyes, merocyanine dyes, cyanine dyes, and azo dyes. Of these, oxonol dyes, hemioxonol dyes, and merocyanine dyes are particularly useful.

The light-sensitive material prepared by the present invention may contain in its photographic emulsion layer or other hydrophilic colloid layer a brightening agent of the stilbene series, triazine series, oxazole series, or coumarine series. They may be water-soluble, or water-insoluble brightening agents may be used in a dispersed state.

In the practice of the present invention, the following known fading-preventing agents can be used in combination. The color image-stabilizing agents to be used in the present invention may be used alone or in combinations of two or more. Known fading-preventing agents include, for example, hydroquinone derivatives, gallic acid derivatives, p-alkoxyphenols, p-hydroxyphenol derivatives, bisphenols, and the like.

The light-sensitive material prepared by the present invention may contain, as a color fog-preventing agent, a hydroquinone derivative, an aminophenol derivative, a gallic acid derivative, an ascorbic acid derivative, etc.

The present invention may also be applied to a multi-layered, multi-color photographic material comprising a support having provided thereon at least two layers differing from each other in spectral sensitivity. Multi-layered, natural color photographic materials usually comprise a support having provided thereon at least one red-sensitive emulsion layer, at least one green-sensitive emulsion layer, and at least one blue-sensitive emulsion layer. The order of these layers may be optionally selected as the case demands. The red-sensitive emulsion layer usually contains a cyan-forming coupler, the green-sensitive emulsion layer a magenta-forming coupler, and the blue-sensitive emulsion layer a yellow-forming coupler. However, in some cases, other combinations may be employed.

In photographic processing of the light-sensitive material of the present invention, any of known processes and known processing solutions may be used. Processing temperature is usually selected between 18° C. and 50° C. However, temperatures lower than 18° C. or higher than 50° C. may be employed.

The color developer generally comprises an alkaline aqueous solution containing a color developing agent. As the color developing agent, known primary aromatic amines such as phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.) may be used.

In addition, those described in L. F. A. Mason; *Photographic Processing Chemistry,* (Focal Press, 1966), pp. 226–229, U.S. Pat. Nos. 2,193,015 and 2,592,364, and Japanese Patent Application (OPI) No. 64933/73, etc., may also be used.

The color developer may further contain pH buffers such as alkali metal sulfites, carbonates, borates, and phosphates, or development inhibitors or antifoggants such as bromides, iodides, and organic antifoggants, and if necessary, may contain water softeners, preservatives such as hydroxylamine, organic solvents such as benzyl alcohol and diethylene glycol, development accelerators such as polyethylene glycol, quaternary ammonium salts, and amines, dye-forming couplers, competitive couplers, fogging agents such as sodium borohydride, auxiliary developing agents such as 1-phenyl-3-pyrazolidone, viscosity-imparting agents, polycarboxylic acid type chelating agents described in U.S. Pat. No. 4,083,723, antioxidants described in West German Application (OLS) No. 2,622,950, and the like.

Color-developed photographic emulsion layers after the color development are usually bleached. Bleaching may be conducted separately or simultaneously with fixing. As bleaching agents, compounds of polyvalent metals such as iron (III), cobalt (III), chromium (VI), copper (II), etc., and peracids, quinones, nitroso compounds, etc., are used. For example, ferricyanates, dichromates, organic complex salts of iron (III) or cobalt (III), such as complex salts of aminopolycarboxylic acids (e.g., ethylenediaminetetraacetic acid, nitrilotriacetic acid, 1,3-diamino-2-propanol tetraacetic acid, or organic acids (e.g., citric acid, tartaric acid, malic acid, etc.)); persulfates, permanganates; nitrosophenol; etc. may be used. Of these, potassium ferricyanate, iron (III) sodium ethylenediaminetetraacetate and iron (III) ammonium ethylenediaminetetraacetate are particularly useful. Iron (III) ethylenediaminetetraacetate is useful in both an independent bleaching solution and a monobath bleach-fixing solution.

To the bleaching or bleach-fixing solution may be added various additives as well as bleaching-accelerating agents described in U.S. Pat. Nos. 3,042,520 and 3,241,966, Japanese Patent Publication Nos. 8506/70 and 8836/70, etc. and thiol compounds described in Japanese Patent Application (OPI) No. 65732/78.

The present invention will now be described in more detail by the following non-limiting examples of the preferred embodiments of the present invention.

EXAMPLE 1

Photographic elements comprising a cellulose acetate film support having provided thereon layers of the following formulations were prepared.

First Layer:

A yellow coupler was mixed with tricresyl phosphate in a mixing ratio of 3/1, then ethyl acetate was added thereto. After dissolving with heating, the resulting solution was emulsified and dispersed in a gelatin aqueous solution containing a surfactant (sodium dodecylbenzenesulfonate) to obtain a yellow coupler emulsified dispersion. This dispersion was then mixed with a silver iodobromide emulsion in a silver-to-coupler ratio of 3.5/1.

Second Layer:

A gelatin aqueous solution mixed with a hardener (1,3-vinylsulfonyl-2-propanol) and a surfactant (Triton X-200) was prepared.

Coated samples 101 to 105 were prepared by changing the yellow coupler as shown in Table 1.

These samples were subjected to white light exposure, then developed as follows at 38° C.

1. Color development 3 min. & 15 sec.
2. Bleaching 6 min. & 30 sec.
3. Washing with water 3 min. & 15 sec.
4. Fixing 6 min. & 30 sec.
5. Washing with water 3 min. & 15 sec.
6. Stabilizing 3 min. & 15 sec.

Formulations of the processing solutions used in respective steps are as follows.

Color Developer
Sodium nitrilotriacetate 1.0 g
Sodium sulfite 4.0 g
Sodium carbonate 30.0 g
Potassium bromide 1.4 g
Hydroxylamine sulfate 2.4 g
4-(N-Ethyl-N-β-hydroxyethylamino)-2-methyl-aniline sulfate 4.5 g
Water to make 1 liter Bleaching Solution
Ammonium bromide 160.0 g
Aqueous ammonia (28%) 25.0 ml
Sodium iron ethylenediaminetetraacetate 130 g
Glacial acetic acid 14 ml
Water to make 1 liter Fixing Solution
Sodium tetrapolyphosphate 2.0 g
Sodium sulfite 4.0 g
Ammonium thiosulfate (70%) 175.0 ml
Sodium bisulfite 4.6 g
Water to make 1 liter Stabilizing Solution
Formalin 8.0 ml
Water to make 1 liter Fog values, relative sensitivities, and Dmax values of the samples having been developed as described above are shown in Table 1 below.

TABLE 1

| Sample | Coupler (Y) | Fog | Relative Sensitivity | Dmax |
|---|---|---|---|---|
| 101 | *Comparative coupler (A)** | 0.07 | 100 | 1.24 |
| 102 | *Comparative coupler (B)** | 0.08 | 132 | 1.52 |
| 103 | *Comparative coupler (C)** | 0.07 | 114 | 1.48 |

TABLE 1-continued

| Sample | Coupler (Y) | Fog | Relative Sensitivity | Dmax |
|---|---|---|---|---|
| 104 | Coupler 3*** | 0.07 | 156 | 1.65 |
| 105 | Coupler 6*** | 0.07 | 135 | 1.59 |

*Comparative coupler (A)*:

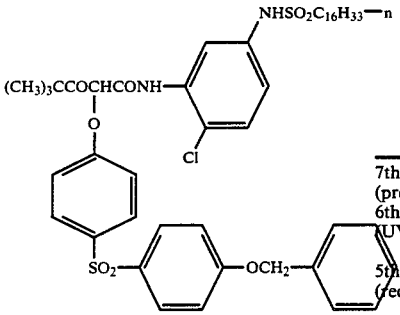

It is seen from the above results that photographic elements having enhanced sensitivity and providing high coloration density without an increase of fog can be obtained by the practice of the present invention.

EXAMPLE 2

On a polyethylene-double-laminated paper support were coated, in sequence, the following 1st layer (lowermost layer) to 7th layer (uppermost layer) to prepare a color photographic light-sensitive material (sample I). (Table 2; mg/m$^2$: coated amount).

TABLE 2

| | | |
|---|---|---|
| 7th layer (protective layer) | Gelatin | 1000 mg/m$^2$ |
| 6th layer (UV ray-absorbing layer) | UV ray absorbent (*1) | 600 mg/m$^2$ |
| | Solvent for UV ray absorbent (*2) | 300 mg/m$^2$ |
| | Gelatin | 800 mg/m$^2$ |
| 5th layer (red-sensitive layer) | AgClBr emulsion (AgBr: 50 mol %) | 300 mg Ag/m$^2$ |
| | Cyan coupler (*30) | 400 mg/m$^2$ |
| | Coupler solvent (*2) | 400 mg/m$^2$ |
| | Gelatin | 1000 mg/m$^2$ |
| 4th layer (interlayer) | UV ray absorbent (*1) | 600 mg/m$^2$ |
| | Solvent for UV ray absorbent (*2) | 300 mg/m$^2$ |
| 3rd layer (green-sensitive layer) | AgClBr emulsion (AgBr: 70 mol %) | 300 mg Ag/m$^2$ |
| | Magenta coupler (*4) | 200 mg/m$^2$ |
| | Coupler solvent (*5) | 200 mg/m$^2$ |
| | Gelatin | 1000 mg/m$^2$ |
| 2nd layer (interlayer) | Gelatin | 1000 mg/m$^2$ |
| First layer (blue-sensitive layer) | AgClBr emulsion (AgBr: 80 mol %) | 300 mg Ag/m$^2$ |
| | Yellow coupler (*6) | 200 mg/m$^2$ |
| | Coupler solvent (*7) | 100 mg/m$^2$ |
| | Gelatin | 800 mg/m$^2$ |
| Support | Polyethylene-double-laminated paper support | |

(*1) UV ray absorbent: 2-(2-hydroxy-3-sec-butyl-5-tert-butylphenyl)benzotriazole
(*2) solvent: dibutyl phthalate
(*3) coupler: 2-[α-(2,4-di-tert-pentylphenoxy)butanamido]-4,6-dichloro-5-methylphenol
(*4) coupler: 1-(2,4,6-trichlorophenyl)-3-(2-chloro-5-tetradecanamido)-anilino-2-pyrazolone-5-one
(*5) solvent: tricresyl phosphate
(*6) coupler: α-pivaloyl-α-(2,4-dihydroxy-5,5'-dimethyloxazolidin-3-yl)-2-chloro-5-[α-(2,4-di-tert-pentyloxy)butanamido]acetanilide
(*7) solvent: di-n-butyl phthalate Comparative coupler (B):

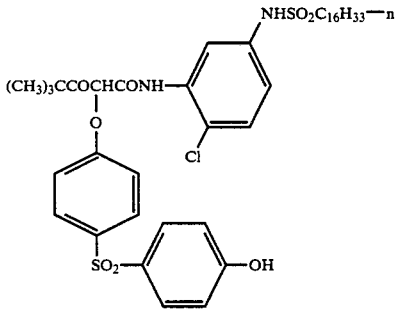

Comparative coupler C:

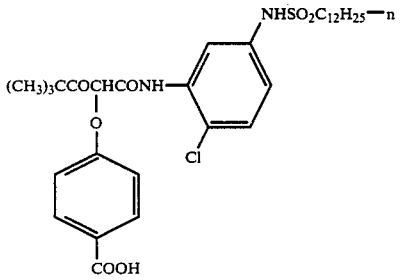

**comparative sample;
***present invention

Samples 201 to 205 were prepared by changing the yellow coupler as shown in Table 3.

TABLE 3

| Sample | | Yellow Coupler |
|---|---|---|
| 201 | Comparative sample | Comparative coupler A |
| 202 | " | Comparative coupler B |
| 203 | Present invention | Coupler 1 |
| 204 | " | Coupler 3 |
| 205 | " | Coupler 6 |

Each sample was exposed to blue light, then developed according to the following steps.

Processing Steps (at 33° C.):
Color development (A) or (B) 3 min. & 30 sec.
Bleach-fixing 1 min. & 30 sec.
Washing with water 3 min.
Drying 10 minutes Formulations of the processing solutions used in respective steps are as follows.

Color Developer (A)
Benzyl alcohol 15 ml
Diethylene glycol 5 ml
Potassium carbonate 25 g
Sodium chloride 0.1 g
Sodium bromide 0.5 g
Anhydrous sodium sulfite 2 g
Hydroxylamine sulfate 2 g N-Ethyl-N-β-methanesulfonamidoethyl-3-methyl-4-aminoaniline sulfate 4 g
Water to make 1 liter
NaOH was added to make pH 10.

Color Developer (B)

The same formulation as color developer (A) except for omitting benzyl alcohol.

Bleach-Fixing Solution

Ammonium thiosulfate 124.5 g
Sodium metabisulfite 13.3 g
Anhydrous sodium sulfite 2.7 g
Ferric ammonium ethylenediaminetetraacetate 65 g
Water to make 1 liter
The pH was adjusted to 6.8.

Color density of each of the developed samples was measured. Fog, gamma, and Dmax of each sample are given in Table 4.

TABLE 4

| | Color developer (A) | | | Color developer (B) | | | |
|---|---|---|---|---|---|---|---|
| Sample | Fog | Gamma | Dmax | Fog | Gamma | Dmax | Note |
| 201 | 0.12 | 2.31 | 2.16 | 0.11 | 1.89 | 1.86 | Comparative sample |
| 202 | 0.13 | 2.45 | 2.32 | 0.12 | 2.22 | 2.13 | Comparative sample |
| 203 | 0.12 | 2.48 | 2.39 | 0.12 | 2.45 | 2.32 | Sample of present invention |
| 204 | 0.12 | 2.50 | 2.37 | 0.11 | 2.47 | 2.35 | Sample of present invention |
| 205 | 0.11 | 2.44 | 2.31 | 0.11 | 2.39 | 2.25 | Sample of present invention |

As is seen from Table 4, comparative samples 201 and 202 underwent serious deterioration of coloration in benzyl alcohol-free color developer (B), whereas samples of the present invention, 203 to 205, showed good coloration properties with almost no reduction in density and gamma.

While the invention has been described in detail and with reference to specific embodiments thereof, it will be apparent to one skilled in the art that various changes and modifications can be made therein without departing from the spirit and scope thereof.

What is claimed is:

1. A color image-forming process comprising developing an exposed silver halide light-sensitive material with an aromatic primary amine color developing agent in the presence of an α-acyl-α-unsubstituted or substituted phenoxyacetanilide type yellow coupler having a sulfamoyl group in a m-position of the acetanilido group with respect to the amino group, which sulfamoyl group is represented by the formula $SO_2NHZ$ where Z represents an alkyl group or an aryl group.

2. A color image-forming process as in claim 1, wherein said α-acyl-α-unsubstituted or substituted phenoxyacetanilide type yellow coupler is represented by formula (I):

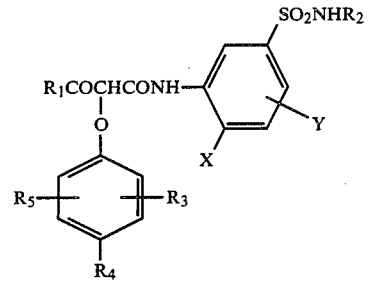

wherein $R_1$ represents an alkyl group or an unsubstituted or substituted aryl group; $R_2$ represents an alkyl group containing from 1 to 32 carbon atoms or an aryl group containing from 6 to 32 carbon atoms; X represents a halogen atom, an alkoxy group containing from 1 to 30 carbon atoms, or a dialkylamino group; Y represents a hydrogen atom or a group capable of being bound to a benzene ring; $R_3$ and $R_5$ each represents a hydrogen atom or a group capable of being bound to a benzene ring; and $R_4$ represents a hydrogen atom, a carboxyl group, an alkyloxycarbonyl group, an aryloxycarbonyl group, an arylsulfonyl group, an alkylsulfonyl group, an arylsulfamoyl group, an arylsulfonamido group, an alkyl group, an alkoxy group, a nitro group, a cyano group, or a carbamoyl group.

3. A color image-forming process as in claim 2, wherein $R_1$ represents a branched alkyl group containing from 3 to 8 carbon atoms or an unsubstituted or substituted aryl group, wherein one or more substituents are selected from the group consisting of a lower alkyl group containing from 1 to 5 carbon atoms, a straight or branched alkoxy group containing from 1 to 30 carbon atoms, a halogen atom, and an acylamino group; $R_2$ represents an alkyl group containing from 1 to 32 carbon atoms or an aryl group containing from 6 to 32 carbon atoms, wherein the aryl group has one or more substituents selected from the group consisting of an aryloxy group, an aryl group, an alkoxycarbonyl group, and an alkoxy group; X represents a halogen atom, an alkoxy group containing from 1 to 30 carbon atoms, or a dialkylamino group; Y represents a hydrogen atom, a halogen atom, a halogen-substituted alkyl group, a cyano group, or an acyl group; $R_3$ and $R_5$ each represents a hydrogen atom, a halogen atom, a carboxyl group, an alkyloxycarbonyl group, an aryloxycarbonyl group, an arylsulfonyl group, an alkylsulfonyl group, an arylsulfamoyl group, an arylsulfonamido group, an alkyl group, an alkoxy group, a nitro group, a cyano group, or a carbamoyl group; and $R_4$ represents a hydrogen atom, a halogen atom, a carboxyl group, an alkyloxycarbonyl group, an aryloxycarbonyl group, an arylsulfonyl group, an alkylsulfonyl group, an arylsulfamoyl group, an arylsulfonamido group, an alkyl group, an alkoxy group, a nitro group, a cyano group, or a carbamoyl group.

4. A color image-forming process as in claim 1, wherein Z is said alkyl group.

5. A color image-forming process as claimed in claim 4, wherein said alkyl group is a straight or branched alkyl group containing from 1 to 32 carbon atoms.

6. A color image-forming process as in claim 1, wherein Z is said aryl group.

7. A color image-forming process as claimed in claim 6, wherein said aryl group contains from 6 to 32 carbon atoms.

* * * * *